US009685105B2

(12) United States Patent
Kim et al.

(10) Patent No.: US 9,685,105 B2
(45) Date of Patent: Jun. 20, 2017

(54) DISPLAY APPARATUS

(71) Applicant: Samsung Display Co., Ltd., Yongin (KR)

(72) Inventors: Kwangmin Kim, Yongin (KR); Wonkyu Kwak, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/793,861

(22) Filed: Jul. 8, 2015

(65) Prior Publication Data

US 2016/0125793 A1 May 5, 2016

(30) Foreign Application Priority Data

Oct. 30, 2014 (KR) ..... 10-2014-0149326

(51) Int. Cl.

| | |
|---|---|
| ***G09G 5/00*** | (2006.01) |
| ***G09G 3/20*** | (2006.01) |
| ***G09G 3/3225*** | (2016.01) |
| ***G09G 3/36*** | (2006.01) |

(52) U.S. Cl.

CPC ..... *G09G 3/20* (2013.01); *G09G 3/3225* (2013.01); *G09G 3/3648* (2013.01); *G09G 2300/0426* (2013.01); *G09G 2300/08* (2013.01); *G09G 2310/0267* (2013.01); *G09G 2320/0223* (2013.01)

(58) Field of Classification Search

CPC ..... G09G 3/2096; G09G 2300/0426; G09G 2310/0286; G09G 2310/0267; G09G 2310/0205; G09G 2320/0233

See application file for complete search history.

(56) References Cited

U.S. PATENT DOCUMENTS

| | | | | |
|---|---|---|---|---|
| 5,270,693 | A * | 12/1993 | Wyler | G04G 9/0035 345/206 |
| 2008/0266210 | A1* | 10/2008 | Nonaka | G09G 3/20 345/55 |
| 2009/0267870 | A1 | 10/2009 | Schellingerhout et al. | |
| 2014/0036191 | A1* | 2/2014 | Zhao | G02F 1/136286 349/46 |

FOREIGN PATENT DOCUMENTS

| | | |
|---|---|---|
| JP | 2009-069768 | 4/2009 |
| KR | 10-2012-0004119 | 1/2012 |
| KR | 10-1301918 | 8/2013 |

* cited by examiner

*Primary Examiner* — Towfiq Elahi

(74) *Attorney, Agent, or Firm* — H.C. Park & Associates, PLC

(57) ABSTRACT

A display apparatus includes: n primary scan lines extending in a first direction, where n denotes a positive integer; n secondary scan lines extending in a second direction that is different from the first direction, the secondary scan lines respectively connected to one of the primary scan lines; pixels connected to the primary scan lines; and a gate driver configured to transmit scan signals to the primary scan lines via the secondary scan lines, wherein a first primary scan line having a first length is connected to a first secondary scan line having a second length, and a second primary scan line having a third length that is longer than the first length is connected to a second secondary scan line having a fourth length that is shorter than the second length.

19 Claims, 7 Drawing Sheets

DISPLAY APPARATUS

CROSS-REFERENCE TO RELATED APPLICATION

This application claims priority from and the benefit of Korean Patent Application No. 10-2014-0149326, filed on Oct. 30, 2014, which is hereby incorporated by reference for all purposes as if fully set forth herein.

BACKGROUND

Field

Exemplary embodiments relate to a display apparatus.

Discussion of the Background

Display apparatuses include a plurality of scan lines and a plurality of pixels connected to the scan lines. Voltage drop may occur in the scan lines due to the resistance of the scan lines. Scan signals are transmitted to pixels via the scan lines having different lengths according to the positions of the pixels. A large difference in the lengths of the scan lines results in a large difference in voltage drops in the scan lines, thereby may cause non-uniform image quality and image quality deterioration.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display apparatus capable of reducing image quality non-uniformity caused by voltage drops.

Additional aspects will be set forth in part in the description which follows and, in part, will be apparent from the disclosure, or may be learned by practice of the inventive concept.

According to one or more exemplary embodiments, a display apparatus includes: n primary scan lines extending in a first direction, where n denotes a positive integer; n secondary scan lines extending in a second direction that is different from the first direction, the secondary scan lines respectively connected to one of the primary scan lines; pixels connected to the primary scan lines; and a gate driver configured to transmit scan signals to the primary scan lines via the secondary scan lines, wherein a first primary scan line having a first length is connected to a first secondary scan line having a second length, and a second primary scan line having a third length that is longer than the first length is connected to a second secondary scan line having a fourth length that is shorter than the second length.

According to one or more exemplary embodiments, a display apparatus includes: n primary scan lines extending in a first direction, where n denotes a positive integer; n secondary scan lines extending in a second direction that is different from the first direction and respectively connected to the n primary scan lines; a plurality of pixels connected to the n primary scan lines; and a gate driver outputting scan signals to the n primary scan lines through the n secondary scan lines, wherein the n primary scan lines include two neighboring primary scan lines, the n secondary scan lines include two secondary scan lines respectively connected to the two neighboring primary scan lines, and the n secondary scan lines includes at least one secondary scan line disposed between the two secondary scan lines.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
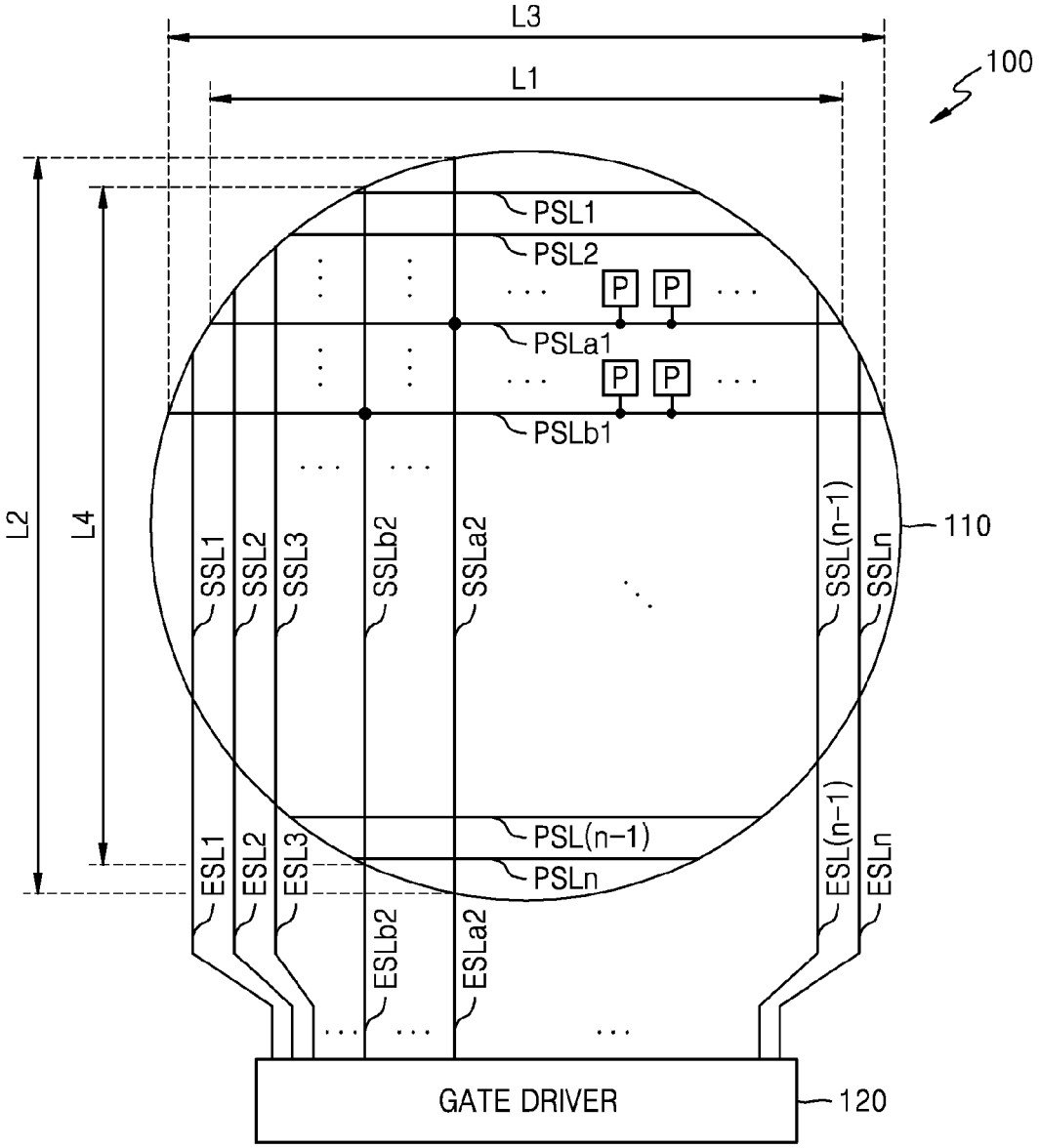
FIG. 1 is a schematic view illustrating a display apparatus according to one or more exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to plan and/or sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. Thus, the regions illustrated in the drawings are schematic in nature and their shapes are not intended to illustrate the actual shape of a region of a device and are not intended to be limiting Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a schematic view illustrating a display apparatus 100 according to one or more exemplary embodiments.

Referring to FIG. 1, the display apparatus 100 of an exemplary embodiment includes a plurality of pixels P, n primary scan lines PSL1 to PSLn, n secondary scan lines SSL1 to SSLn, and a gate driver 120. The display apparatus 100 may include a display unit 110 and n extension scan lines ESL1 to ESLn.

The display apparatus 100 may be a flat display apparatus such as an organic light emitting diode (OLED) display, a thin film transistor liquid crystal display (TFT-LCD), a plasma display panel (PDP), or a light emitting diode (LED) display. However, the display apparatus 100 is not limited thereto. That is, the display apparatus 100 may be any display apparatus capable of receiving image signals and displaying images corresponding to the image signals. The display apparatus 100 may also be an electronic apparatus such as a smartphone, a personal computer (PC), a laptop PC, a monitor, or a TV, or may be an image display component of such an electronic apparatus. According to the following description, the exemplary display apparatus 100 is an OLED display.

Each of the pixels P may include a light emitting device and a pixel circuit connected to the light emitting device. The light emitting device may be an OLED. The pixel circuit may transmit a current to the light emitting device according to the level of light emission of the light emitting device. The pixel circuit may transmit a current to the light emitting device according to the light emission timing of the light emitting device. FIG. 1 illustrates only four pixels P on the display unit 110 merely for the convenience of explanation, and the exemplary embodiments are not limited thereto. That is, each of the primary scan lines PSL1 to PSLn may be connected to the plurality of pixels P, respectively.

The pixels P may include a plurality of sub-pixels for displaying a plurality of colors and thus expressing various colors. Throughout the present specification, a pixel may refer to a sub-pixel and/or sub-pixels constituting a unit pixel.

The pixels P may be connected to the primary scan lines PSL1 to PSLn. The pixels P may receive scan signals through the primary scan lines PSL1 to PSLn. The pixels P may receive data signals through data lines DL1 to DLm (refer to FIG. 4). The data signals may be respectively transmitted to the pixels P through the data lines DL1 to DLm in synchronization with the scan signals transmitted through the primary scan lines PSL1 to PSLn. The light emitting devices of the pixels P may emit light having brightness levels corresponding to the data signals respectively transmitted to the pixels P. For example, the pixels P may include an organic emission layer disposed between a pixel electrode and an opposite electrode, and a current corresponding to the data signals may be applied to the organic emission layer so that the light emission layer may emit light having brightness levels corresponding to the data signals.

The primary scan lines PSL1 to PSLn may extend in a first direction. The primary scan lines PSL1 to PSLn may be sequentially arranged in a second direction different from the first direction. The primary scan lines PSL1 to PSLn may be first to nth primary scan lines PSL1 to PSLn sequentially arranged in the second direction. The first and second directions may be orthogonal to each other. For example, the first direction may be a left-to-right direction, and the second direction may be an up-to-down direction. In this case, the primary scan line disposed at the upper end side of the display unit 110 may be the first primary scan line PSL1, and the second primary scan line PSL2 may be placed adjacent to the lower side of the first primary scan line PSL1. Accordingly, the nth primary scan line PSLn may be disposed at the lower end side of the display unit 110.

A primary scan line of the primary scan lines PSL1 to PSLn disposed closer to the center of the display unit 110 may have a length equal to or longer than the length of primary scan lines of the primary scan lines PSL1 to PSLn disposed farther from the center of the display unit 110. For example, the number of the primary scan lines PSL1 to PSLn may be a positive integer of 2k, k may refer to a positive integer, and j may refer to a positive integer less than k. In this case, the length of the jth primary scan line PSLj may be equal to or shorter than the length of the (j+1)th primary scan line PSL(j+1), and the length of the (k+j)th primary scan line PSL(k+j) may be equal to or longer than the length of the (k+j+1)th primary scan line PSL(k+j+1). Herein, the lengths of the primary scan lines PSL1 to PSLn may be lengths within the display unit 110.

The primary scan lines PSL1 to PSLn may transmit scan signals to the pixels P. The total number of the primary scan lines PSL1 to PSLn included in the display apparatus 100 may be n.

The secondary scan lines SSL1 to SSLn may extend in the second direction. The secondary scan lines SSL1 to SSLn may be sequentially arranged in the first direction. The secondary scan lines SSL1 to SSLn be first to nth secondary scan lines SSL1 to SSLn sequentially arranged in the first direction. For example, the first direction may be a left-to-right direction, and the second direction may be an up-to-down direction. In this case, the secondary scan line disposed at the left end side of the display unit 110 may be the first secondary scan line SSL1, and the second secondary scan line SSL2 may be placed close to the right side of the first secondary scan line SSL1. Accordingly, the nth secondary scan line SSLn may be disposed at the right end side of the display unit 110. For example, the first direction may be a right-to-left direction, and the second direction may be an up-to-down direction. In this case, the secondary scan line disposed at the right end side of the display unit 110 may be the first secondary scan line SSL1, and the second secondary scan line SSL2 may be placed close to the left side of the first secondary scan line SSL1. Accordingly, the nth secondary scan line SSLn may be disposed at the left end side of the display unit 110.

A secondary scan line of the secondary scan lines SSL1 to SSLn disposed closer to the center of the display unit 110 may have a length equal to or longer than the length of secondary scan lines of the secondary scan lines SSL1 to SSLn disposed farther from the center of the display unit 110. For example, the number of the secondary scan lines SSL1 to SSLn may be a positive integer of 2k, k may refer to a positive integer, and j may refer to a positive integer less than k. The length of the jth secondary scan line SSLj may be equal to or shorter than the length of the (j+1)th secondary scan line SSL(j+1), and the length of the (k+j)th secondary scan line SSL(k+j) may be equal to or longer than the length of the (k+j+1)th secondary scan line SSL(k+j+1). Herein, the lengths of the secondary scan lines SSL1 to SSLn may be lengths within the display unit 110.

The secondary scan lines SSL1 to SSLn may transmit scan signals to the primary scan lines PSL1 to PSLn, respectively.

The primary scan lines PSL1 to PSLn may be connected to the secondary scan lines SSL1 to SSLn, respectively. A primary scan line having a relatively longer length may be connected to a secondary scan line having a relatively shorter length. For example, the (a1)th primary scan line PSLa1 having a first length L1 may be connected to the (a2)th secondary scan line SSLa2 having a second length L2, and the (b1)th primary scan line PSLb1 having a third length L3 may be connected to the (b2)th secondary scan line SSLb2 having a fourth length L4. In this case, if the first length L1 is shorter than the third length L3, the second length L2 may be longer than the fourth length L4.

Each of the extension scan lines ESL1 to ESLn may include a first end and a second end. The first end of each of the extension scan lines ESL1 to ESLn may be connected to the gate driver 120. The second end of each of the extension scan lines ESL1 to ESLn may be connected to a corresponding one of the secondary scan lines SSL1 to SSLn, respectively.

The total number of the extension scan lines ESL1 to ESLn included in the display apparatus 100 may be n. The extension scan lines ESL1 to ESLn may be sequentially arranged. The first to nth extension scan lines ESL1 to ESLn may be sequentially connected to the first to nth secondary scan lines SSL1 to SSLn, respectively. The extension scan lines ESL1 to ESLn may receive scan signals transmitted from the gate driver 120 and transmit the scan signals to the secondary scan lines SSL1 to SSLn, respectively.

A secondary scan line and an extension scan line connected to each other may be a single conductive line or two conductive lines electrically connected to each other. For example, the (a2)th secondary scan line SSLa2 may be two conductive lines electrically connected to the (a2)th extension scan line ESLa2. For example, the (a2)th secondary scan line SSLa2 and the (a2)th extension scan line ESLa2 may be a single conductive line including regions named differently. A boundary point between a secondary scan line and an extension scan line that are connected to each other may be disposed at the edge of the display unit 110. For example, if the (a2)th secondary scan line SSLa2 and the (a2)th extension scan line ESLa2 are two conductive lines, a connection point between the two conductive lines may be disposed at the edge of the display unit 110. If the (a2)th secondary scan line SSLa2 and the (a2)th extension scan line ESLa2 are a single conductive line, a boundary point of the single conductive line at which the (a2)th secondary scan line SSLa2 and the (a2)th extension scan line ESLa2 are divided may be a disposed where the single conductive line crosses the edge of the display unit 110.

The display unit 110 may display images. The display unit 110 may be a flat display panel such as an OLED panel or liquid crystal (LC) panel. However, the display unit 110 is not limited thereto. The display unit 110 may be a region in which the n primary scan lines PSL1 to PSLn, the n secondary scan lines SSL1 to SSLn, and the pixels P are disposed.

The display unit 110 may have a central width equal to or greater than an outer width thereof. Referring to FIG. 1, the display unit 110 may have a circular shape. However, the display unit 110 is not limited thereto.

The gate driver 120 may transmit scan signals to the primary scan lines PSL1 to PSLn. The gate driver 120 may generate scan signals and transmit the scan signals sequentially to the pixels P through the primary scan lines PSL1 to PSLn. The gate driver 120 may transmit the scan signals to the primary scan lines PSL1 to PSLn through the secondary scan lines SSL1 to SSLn.

The gate driver 120 may have a width narrower than the central width of the display unit 110. Accordingly, all and/or some of the extension scan lines ESL1 to ESLn may be bent or curved. For example, FIG. 1 illustrates that extension scan lines ESL1, ESL2, ESL3, ESL(n−1), and ESLn connected to the secondary scan lines SSL1, SSL2, SSL3, SSL(n−1), and SSLn of the display unit 110 may be bent. However, exemplary embodiments are not limited thereto.

In the display apparatus 100, the number of the primary scan lines PSL1 to PSLn, the number of the secondary scan lines SSL1 to SSLn, and the number of the extension scan lines ESL1 to ESLn may be equal to n. In the following description, unless otherwise specified, the display apparatus 100 includes n primary scan lines PSL1 to PSLn, n secondary scan lines SSL1 to SSLn, and n extension scan lines ESL1 to ESLn, where n is a positive integer of 2k and k is a positive integer.

Figure 2A:
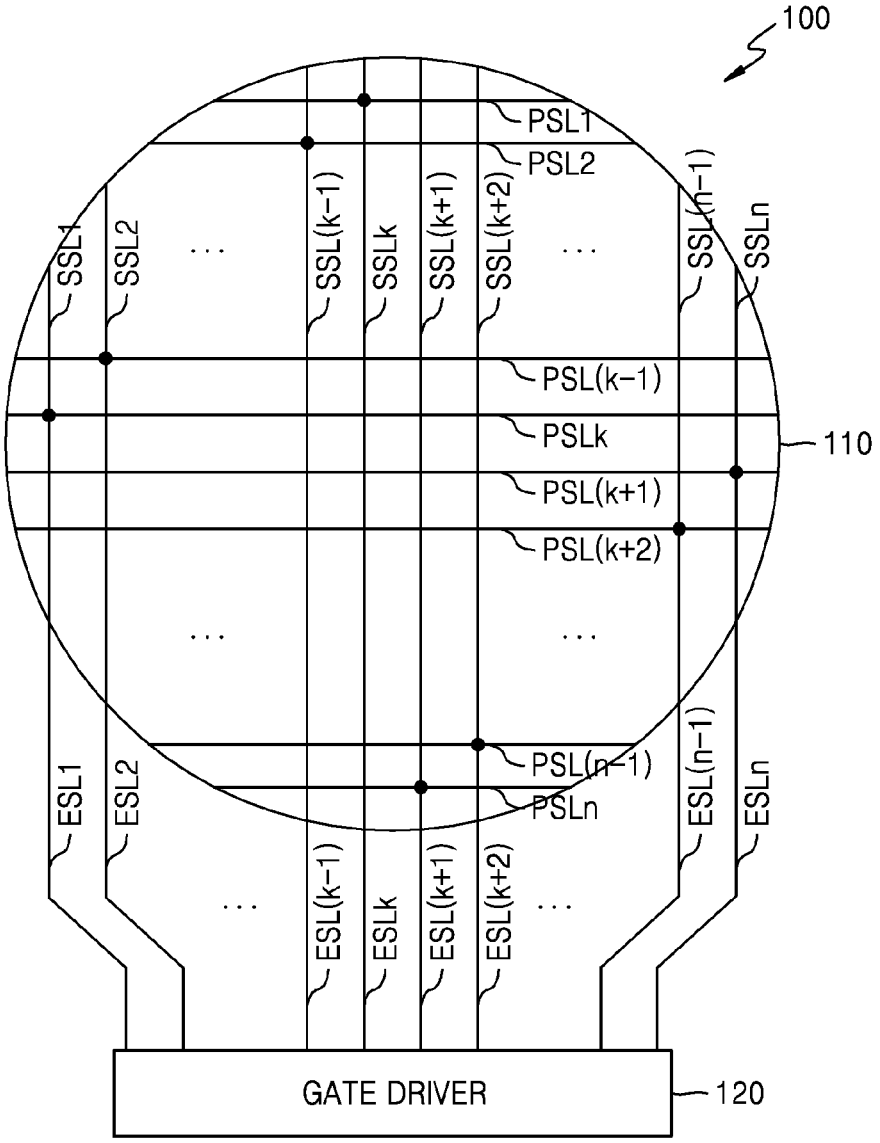
FIGS. 2A and 2B are schematic views illustrating exemplary positions at which primary scan lines and secondary scan lines are connected according to one or more exemplary embodiments.
Figure 2B:
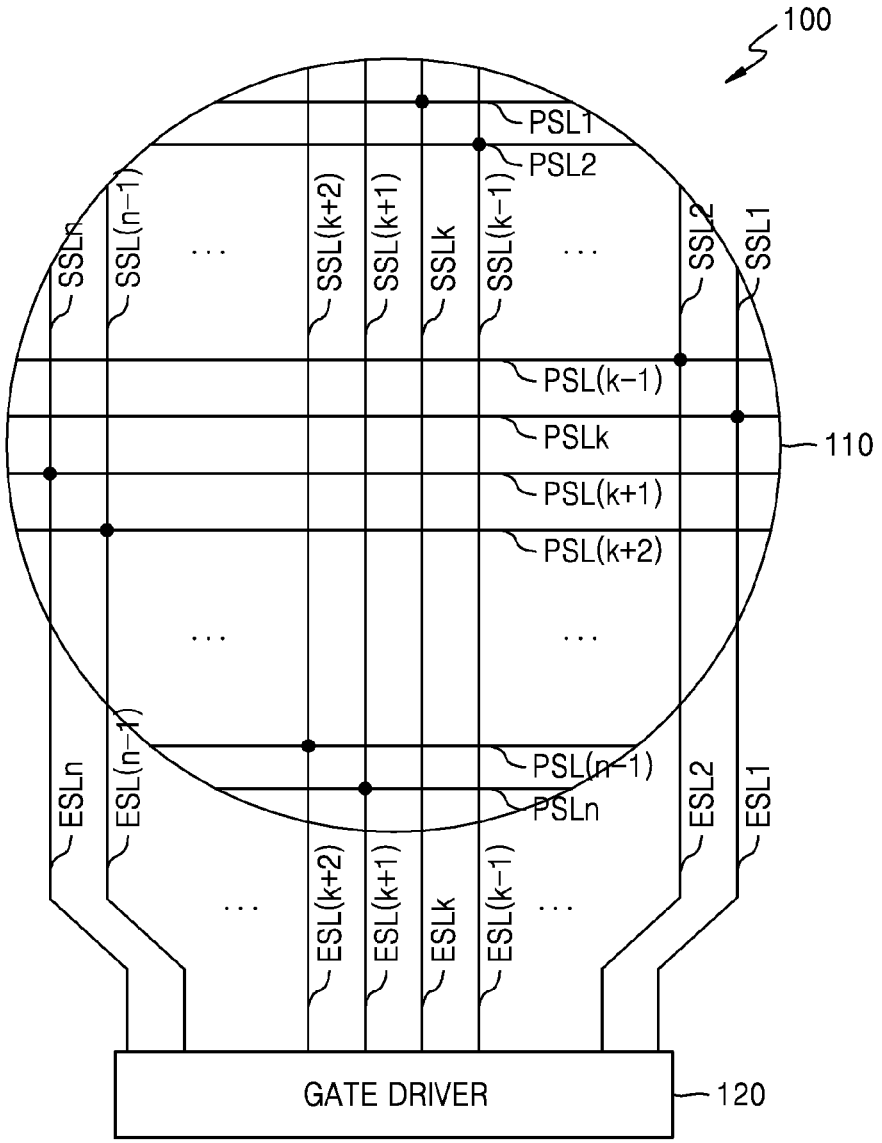

FIGS. 2A and 2B are schematic views illustrating exemplary positions at which primary scan lines and secondary scan lines are connected according to one or more exemplary embodiments.

Referring to FIGS. 2A and 2B, according to the exemplary embodiments, a display apparatus 100 may include first to nth primary scan lines PSL1 to PSLn, first to nth secondary scan lines SSL1 to SSLn, first to nth extension scan lines ESL1 to ESLn, and a gate driver 120. In the exemplary embodiments illustrated in FIGS. 2A and 2B, the display apparatus 100 may have configuration modified compared from the exemplary embodiment illustrated in FIG. 1, which may be described in connection with the following description.

The first to kth primary scan lines PSL1 to PSLk may be sequentially connected to the kth to first secondary scan lines SSLk to SSL1, respectively. Referring to FIG. 2A, a first direction may be defined as a left-to-right direction, and a second direction may be defined as an up-to-down direction. The first primary scan line PSL1 may be connected to the kth secondary scan line SSLk, and the second primary scan line PSL2 may be connected to the (k−1)th secondary scan line SSL(k−1). In this manner, the (k−1)th primary scan line PSL(k−1) may be connected to the second secondary scan line SSL2, and the kth primary scan line PSLk may be connected to the first secondary scan line SSL1. Accordingly, connection points between the first to kth primary scan lines PSL1 to PSLk and the kth to first secondary scan lines SSLk to SSL1 are disposed in an upper left region of a display unit 110. Referring to FIG. 2B, the first direction may be defined as a right-to-left direction, and the second direction may be defined as an up-to-down direction. The connection points between the first to kth primary scan lines PSL1 to PSLk and the kth to first secondary scan lines SSLk to SSL1 are disposed in an upper right region of the display unit 110.

The (k+1)th to nth primary scan lines PSL(k+1) to PSLn may be sequentially connected to the nth to (k+1)th secondary scan lines SSLn to SSL(k+1), respectively. Referring to FIG. 2A, the first direction may be defined as a left-to-right direction, and the second direction may be defined as an up-to-down direction. The (k+1)th primary scan line PSL(k+1) may be connected to the nth secondary scan line SSLn, and the (k+2)th primary scan line PSL(k+2) may be connected to the (n−1)th secondary scan line SSL(n−1). In this manner, the (n−1)th primary scan line PSL(n−1) may be connected to the (k+2)th secondary scan line SSL(k+2), and the nth primary scan line PSLn may be connected to the (k+1)th secondary scan line SSL(k+1). Accordingly, connection points between the (k+1)th to nth primary scan lines PSL(k+1) to PSLn and the nth to (k+1)th secondary scan lines SSLn to SSL(k+1) are disposed in a lower right region of the display unit 110. Referring to FIG. 2B, the first direction may be defined as a right-to-left direction, and the second direction may be defined as an up-to-down direction. The connection points between the (k+1)th to nth primary scan lines PSL(k+1) to PSLn and the nth to (k+1)th secondary scan lines SSLn to SSL(k+1) are disposed in a lower left region of the display unit 110.

Figure 3A:
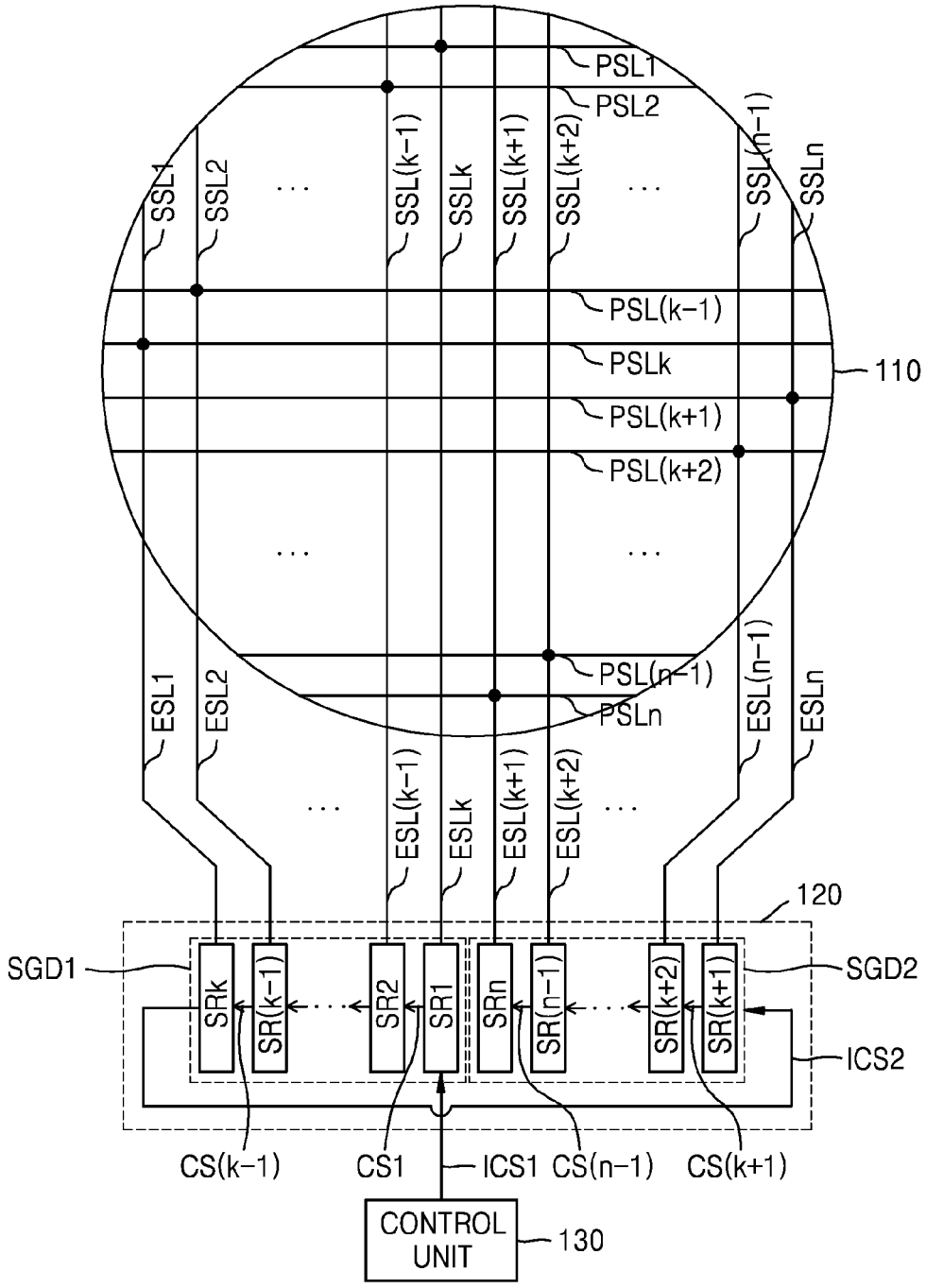
FIGS. 3A and 3B are schematic views illustrating an exemplary method of outputting scan signals from a gate driver to scan lines according to one or more exemplary embodiments.
Figure 3B:
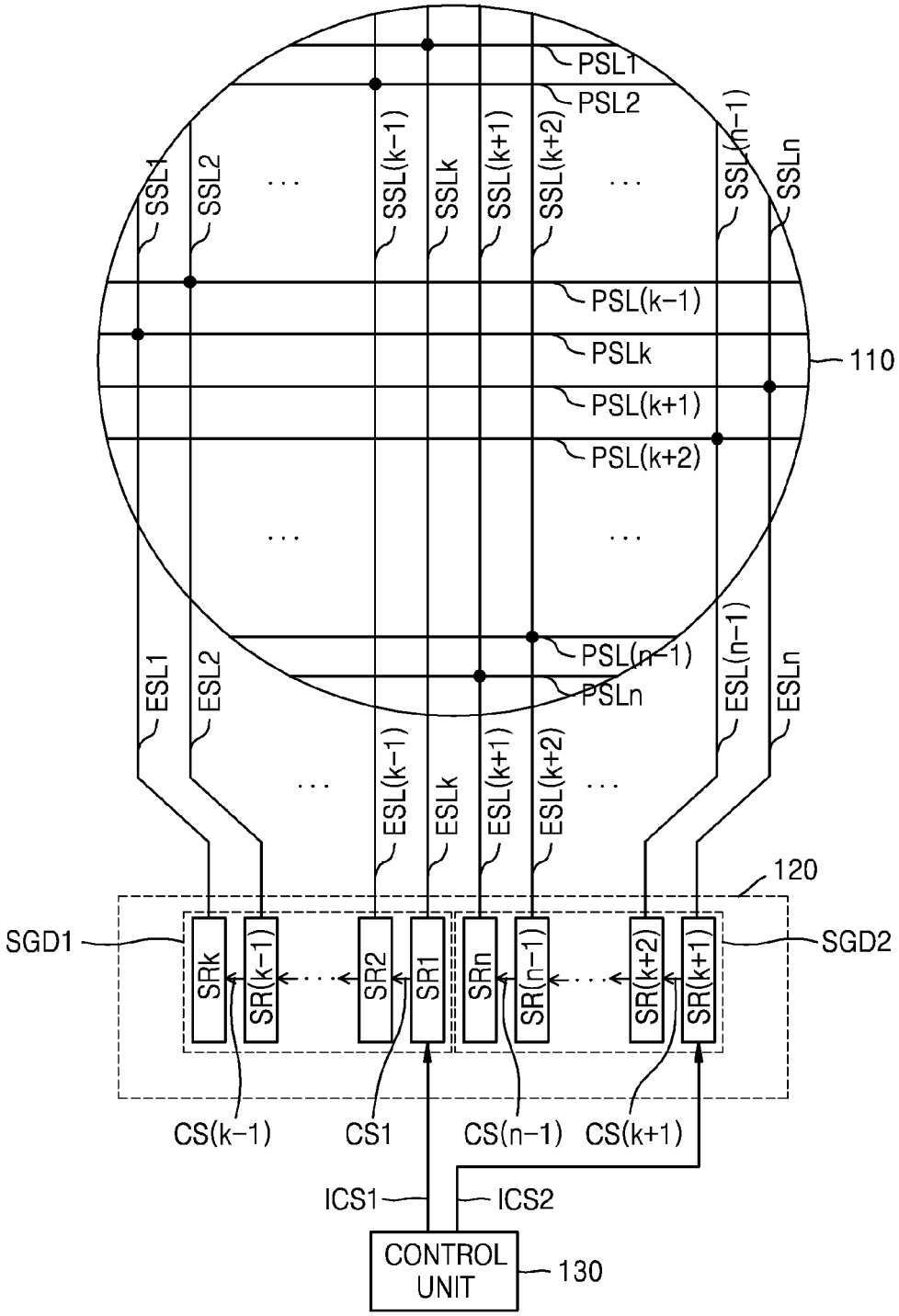

FIGS. 3A and 3B are schematic views illustrating an exemplary method of outputting scan signals from a gate driver to scan lines according to one or more exemplary embodiments.

Referring to FIGS. 3A and 3B, a display apparatus 100 of the current exemplary embodiment may include first to nth primary scan lines PSL1 to PSLn, first to nth secondary scan lines SSL1 to SSLn, first to nth extension scan lines ESL1 to ESLn, a gate driver 120, and a control unit 130. The gate driver 120 may include a first sub-gate driver SGD1 and a second sub-gate driver SGD2. The first sub-gate driver SGD1 may include first to kth shift registers SR1 to SRk. The second sub-gate driver SGD2 may include (k+1)th to nth shift registers SR(k+1) to SRn. According to the exemplary embodiments illustrated in FIGS. 3A and 3B, some elements are added compared to the exemplary embodiments illustrated in FIG. 2A, which may be described in connection with the following description.

The first to kth shift registers SR1 to SRk of the first sub-gate driver SGD1 may be sequentially arranged in a third direction opposite a first direction. Referring to FIGS. 3A and 3B, the first direction may be a left-to-right direction. Accordingly, the third direction may be a right-to-left direction, and the first to kth shift registers SR1 to SRk are sequentially arranged from right to left. The (k+1)th to nth shift registers SR(k+1) to SRn of the second sub-gate driver SGD2 may be sequentially arranged in the third direction opposite the first direction. The first sub-gate driver SGD1 and the second sub-gate driver SGD2 may be sequentially arranged in the first direction.

The first to kth shift resisters SR1 to SRk may transmit scan signals to the kth to first secondary scan lines SSLk to SSL1, respectively. The first sub-gate driver SGD1 may transmit scan signals to the kth to first secondary scan lines SSLk to SSL1 through the kth to first extension scan lines ESLk to ESL1 respectively connected to the first to kth shift resisters SR1 to SRk. The (k+1)th to nth shift registers SR(k+1) to SRn may transmit scan signals to the nth to (k+1)th secondary scan lines SSLn to SSL(k+1), respectively. The second sub-gate driver SGD2 may transmit scan signals to the nth to (k+1)th secondary scan lines SSLn to SSL(k+1) through the nth to (k+1)th extension scan lines ESLn to ESL(k+1) respectively connected to the (k+1)th to nth shift resisters SR(k+1) to SRn.

The first to kth shift registers SR1 to SRk of the first sub-gate driver SGD1 may sequentially transmit scan signals. In detail, the first shift register SR1 may transmit a scan signal to the kth secondary scan line SSLk through the kth extension scan line ESLk in response to receiving a first initial control signal ICS1, and the first shift register SR1 may transmit a first shift control signal CS1 to the second shift register SR2. The second shift register SR2 may transmit a scan signal to the (k−1)th secondary scan line SSL(k−1) through the (k−1)th extension scan line ESL(k−1) in response to receiving the first shift control signal CS1, and the second shift register SR2 may transmit a second shift control signal CS2 to the third shift register SR3. Accordingly, an ith shift register SRi may transmit a scan signal to a (k−i+1)th secondary scan line SSL(k−i+1) through an (k−i+1)th extension scan line ESL(k−i+1) in response to receiving an (i−1)th shift control signal ICS(i−1), and the ith shift register SRi may transmit an ith shift control signal CSi to an (i+1)th shift register SR(i+1). Here, i may be any positive integer between 2 and (k−1).

The (k+1)th to nth shift registers SR(k+1) to SRn of the second sub-gate driver SGD2 may sequentially transmit scan signals. In detail, the (k+1)th shift register SR(k+1)

may transmit a scan signal to the nth secondary scan line SSLn through the nth extension scan line ESLn in response to receiving a second initial control signal ICS2, and the (k+1)th shift register SR(k+1) may transmit a (k+1)th shift control signal CS(k+1) to the (k+2)th shift register SR(k+2). The (k+2)th shift register SR(k+2) may transmit a scan signal to the (n−1)th secondary scan line SSL(n−1) through the (n−1)th extension scan line ESL(n−1) in response to receiving the (k+1)th shift control signal CS(K+1), and the (k+2)th shift register SR(k+2) may transmit a (k+2)th shift control signal CS(k+2) to the (k+3)th shift register SR(k+3). Accordingly, an (k+i)th shift register SR(k+i) may transmit a scan signal to a (n−i+1)th secondary scan line SSL(n−i+1) through an (n−i+1)th extension scan line ESL(n−i+1) in response to receiving an (k+i−1)th shift control signal ICS (k+i−1), and the (k+i)th shift register SR(k+i) may transmit an (k+i)th shift control signal CS(k+i) to an (k+i+1)th shift register SR(k+i+1). Here, i may be any positive integer between 2 and (k−1).

The control unit 130 may transmit the first initial control signal ICS1 to the first shift register SR1. Referring to FIG. 3A, the kth shift register SRk may transmit the second initial control signal ICS2 to the (k+1)th shift register SR(k+1) in response to receiving a (k−1)th shift control signal CS(k−1). Referring to FIG. 3B, the control unit 130 may transmit the second initial control signal ICS2 to the (k+1)th shift register SR(k+1). In this case, the control unit 130 may transmit the second initial control signal ICS2 to the (k+1)th shift register SR(k+1) in synchronization with the kth shift register SRk transmitting a scan signal to the first secondary scan line SSL1.

FIGS. 3A and 3B illustrate an exemplary arrangement of the first to nth shift resisters SR1 to SRn according to the exemplary embodiment illustrated in FIG. 2A. Accordingly, the first to nth shift registers SR1 to SRn of the first to nth shift resisters SR1 to SRn illustrated in FIGS. 3A and 3B may be arranged according to the exemplary embodiment of FIG. 2B, including a bilateral symmetry arrangement with the arrangement of the first to nth shift registers SR1 to SRn illustrated in FIGS. 3A and 3B. That is, the gate driver may include the second sub-gate driver SGD2 including, in a left-to-right direction, the (k+1)th to nth shift register SR(k+1) to SRn sequentially arranged in a left-to-right direction, and the first sub-gate driver SGD1 including the first to kth shift registers SR1 to SRk sequentially arranged in a left-to-right direction. However, the structure of the gate driver 120 is not limited thereto. That is, the gate driver 120 may have any other structure configured to sequentially supply scan signals to the first to nth secondary scan lines SSL1 to SSLn.

Figure 4:
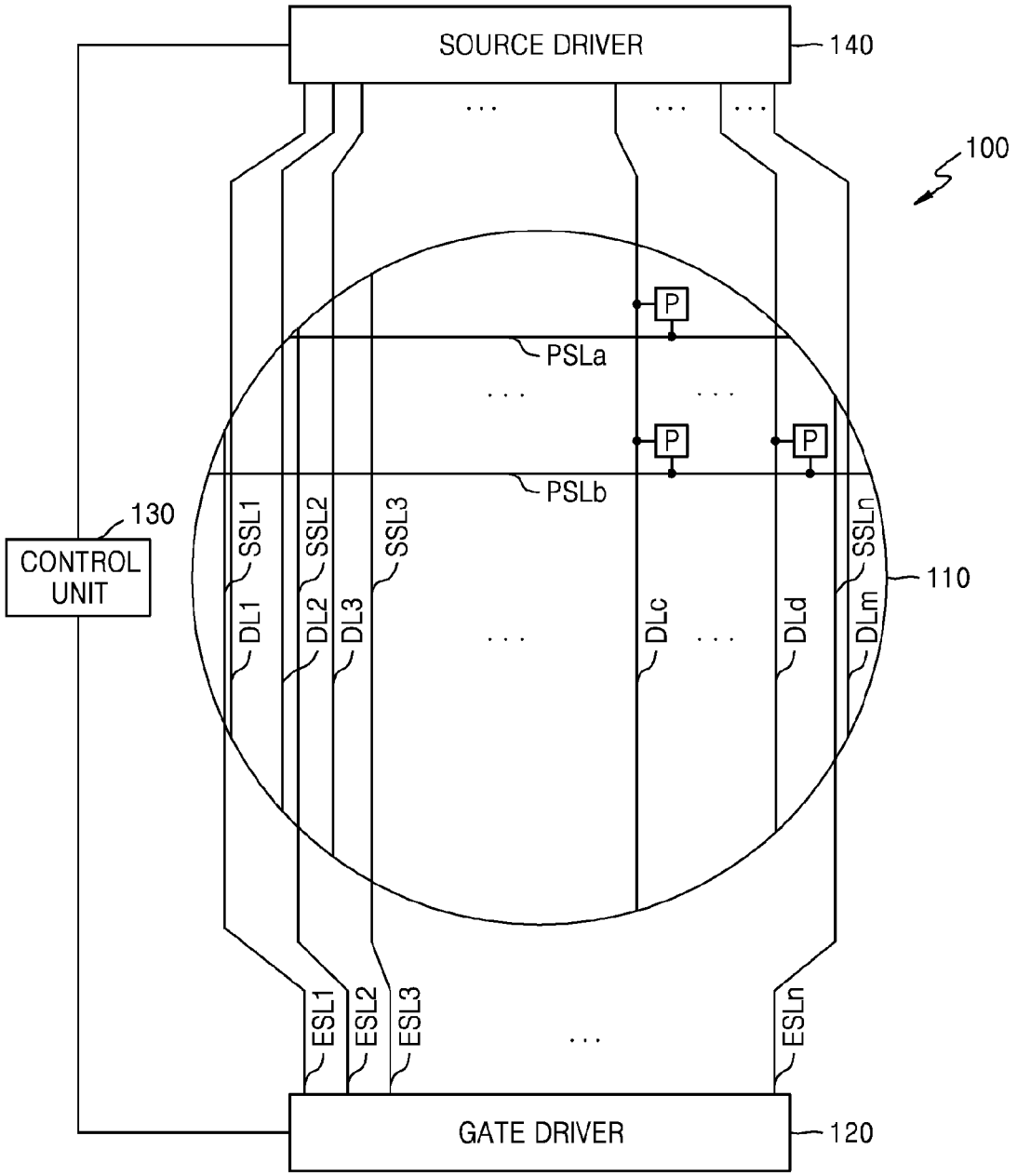
FIG. 4 is a schematic view illustrating a display apparatus according to one or more exemplary embodiments.

FIG. 4 is a schematic view illustrating a display apparatus 100 to one or more exemplary embodiments.

Referring to FIG. 4, the display apparatus 100 of an exemplary embodiment may include a plurality of pixels P, n primary scan lines PSL1 to PSLn, n secondary scan lines SSL1 to SSLn, n extension scan lines ESL1 to ESLn, a gate driver 120, a control unit 130, and a source driver 140. According to the exemplary embodiment illustrated in FIG. 4, some elements are added compared to the exemplary embodiments described with reference to FIG. 1, which may be described in connection with the following description.

Data lines DL1 to DLm may be disposed extending in the second direction. The data lines DL1 to DLm may include first to mth data lines DL1 to DLm sequentially arranged in the first direction.

A plurality of pixels P may be disposed at where each of the first to nth primary scan lines PSL1 to PSLn crosses each of the first to mth data lines DL1 to DLm. The number of pixels P connected to relatively longer primary scan lines of the primary scan lines PSL1 to PSLn may be equal to or greater than the number of pixels P connected to relatively shorter primary scan lines of the primary scan lines PSL1 to PSLn. For example, an ath primary scan line PSLa may have a first length L1, a bth primary scan line PSLb may have a third length L3 longer than the first length L1, a cth data line DLc may cross both the ath primary scan line PSLa and the bth primary scan line PSLb, and a dth data line DLd may the bth primary scan line PSLb but not the ath primary scan line PSLa. Pixels P may be disposed where the ath primary scan line PSLa and the cth data line DLc cross each other, where the bth primary scan line PSLb and the cth data line DLc cross each other, and where the bth primary scan line PSLb and the dth data line DLd cross each other. The bth primary scan line PSLb may be relatively longer than the ath primary scan line PSLa, and may be connected to more pixels P than the ath primary scan line PSLa. If all data lines crossing the bth primary scan line PSLb also cross the ath primary scan line PSLa, the number of pixels P connected to the ath primary scan line PSLa may be equal to the number of pixels P connected to the bth primary scan line PSLb.

The control unit 130 may transmit control signals such as a first initial control signal ICS1 to the gate driver 120. The control unit 130 may transmit data signals to the source driver 140.

The source driver 140 may transmit a plurality of data signals to a display unit 110 through the first to mth data lines DL1 to DLm in synchronization with scan signals.

In exemplary embodiments, the gate driver 110, the gate driver 120 including the first sub-gate driver SGD1 and the second sub-gate driver SGD2, the control unit 130, the source driver 140, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the gate driver 110, the gate driver 120 including the first sub-gate driver SGD1 and the second sub-gate driver SGD2, the control unit 130, the source driver 140, and/or one or more components thereof may include or otherwise be associated with one or more memories (not shown) including code (e.g., instructions) configured to cause the gate driver 110, the gate driver 120 including the first sub-gate driver SGD1 and the second sub-gate driver SGD2, the control unit 130, the source driver 140, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CDRW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 5:
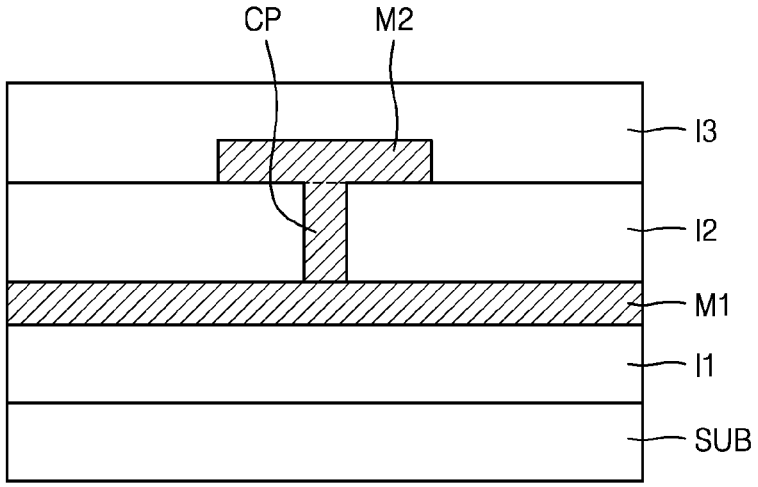
FIG. 5 is a sectional view illustrating an exemplary method of connecting a primary scan line and a secondary scan line according to one or more exemplary embodiments.

FIG. 5 is a sectional view illustrating an exemplary method of connecting a primary scan line and a secondary scan line according to one or more exemplary embodiments.

Referring to FIG. 5, a display apparatus 100 of the current exemplary embodiment may include a substrate SUB, a first insulation layer I1 disposed on the substrate SUB, a first metal layer M1 disposed on the first insulation layer I1, a second insulation layer I2 disposed on the first metal layer M1, a second metal layer M2 disposed on the second insulation layer I2 and connected to the first metal layer M1 through a contact plug CP penetrating through the second insulation layer I2, and a third insulation layer I3 disposed on the second insulation layer I2 and the second metal layer M2.

The first to nth primary scan lines PSL1 to PSLn and the first to nth secondary scan lines SSL1 to SSLn may be disposed on different layers. The primary scan lines PSL1 to PSLn may be electrically connected to the secondary scan lines SSL1 to SSLn through contact plugs CP, respectively. Referring to FIG. 5, the first metal layer M1 may be an (a1)th primary scan line PSLa1, and the second metal layer M2 may be an (a2)th secondary scan line SSLa2 connected to the (a1)th primary scan line PSLa1. The (a1)th primary scan line PSLa1 and the (a2)th secondary scan line SSLa2 may be electrically connected to each other through the contact plug CP.

According to the one or more exemplary embodiments, the display apparatus may have improved image quality since the voltage drops in scan lines may be reduced.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display apparatus comprising:

n primary scan lines extending in a first direction, where n denotes a positive integer;

n secondary scan lines extending in a second direction that is different from the first direction, the secondary scan lines respectively connected to one of the primary scan lines;

pixels connected to the primary scan lines;

a gate driver configured to transmit scan signals to the primary scan lines via the secondary scan lines;

a first metal layer comprising the primary scan lines;

a second metal layer comprising the secondary scan lines;

an insulation layer disposed between the first and second metal layers; and contact plugs penetrating the insulation layer and connecting the primary scan lines and the secondary scan lines, wherein a first primary scan line having a first length is connected to a first secondary scan line having a second length, and a second primary scan line having a third length that is longer than the first length is connected to a second secondary scan line having a fourth length that is shorter than the second length.

2. The display apparatus of claim 1, wherein the primary scan lines further comprise first to nth primary scan lines sequentially arranged in the second direction, the secondary scan lines further comprising first to nth secondary scan lines sequentially arranged in the first direction, wherein a primary scan line disposed closer to a center of the display apparatus has a length that is equal to or longer than a length of a primary scan line disposed farther from the center of the display apparatus, and wherein a secondary scan line disposed closer to the center of the display apparatus has a length that is equal to or longer than a length of a secondary scan line disposed farther from the center of the display apparatus.

3. The display apparatus of claim 2, wherein a jth primary scan line has a length that is equal to or shorter than a length of a (j+1)th primary scan line, and a (k+j)th primary scan line has a length that is equal to or longer than a length of a (k+j+1)th primary scan line; and a (j)th secondary scan line has a length that is equal to or shorter than a length of a (j+1)th secondary scan line, and a (k+j)th secondary scan line has a length that is equal to or longer than a length of a (k+j+1)th secondary scan line, wherein n denotes a positive integer of 2k, k denotes a positive integer, and j denotes a positive integer that is less than k.

4. The display apparatus of claim 2, wherein the first to a kth primary scan lines are connected to a kth to the first secondary scan lines, respectively, and a (k+1)th to the nth primary scan lines are connected to the nth to a (k+1)th secondary scan lines, respectively, where n denotes a positive integer of 2k and k denotes a positive integer.

5. The display apparatus of claim 2, wherein the gate driver comprises:

a first sub-gate driver and a second sub-gate driver, wherein the first sub-gate driver comprises first to kth shift registers sequentially arranged in a third direction that is opposite the first direction, wherein the second sub-gate driver comprises (k+1)th to nth shift registers sequentially arranged in the third direction, wherein the first to kth shift registers are configured to transmit scan signals to a kth to the first secondary scan lines, respectively, and wherein the (k+1)th to nth shift registers are configured to transmit scan signals to the nth to a (k+1)th secondary scan lines, respectively, where n denotes a positive integer of 2k and k denotes a positive integer.

6. The display apparatus of claim 5, further comprising a control unit configured to transmit a first initial control signal, wherein the first shift register of the first sub-gate driver is configured to transmit a first shift control signal to the second shift register of the first sub-gate driver in response to receiving the first initial control signal, and an ith shift register of the first sub-gate driver is configured to transmit an ith shift control signal to a (i+1)th shift register of the first sub-gate driver in response to receiving a (i−1)th shift control signal, wherein the (k+1)th shift register of the second sub-gate driver is configured to transmit a (k+1)th shift control signal to the (k+2)th shift register in response to receiving a second initial control signal, and a (k+i)th shift register of the second sub-gate driver is configured to transmit a (k+i)th shift control signal to a (k+i+1)th shift register of the second sub-gate driver in response to receiving a (k+i−1)th shift control signal, where i denotes a positive integer between 2 and (k−1).

7. The display apparatus of claim 6, wherein the kth shift register is configured to transmit the second initial control signal to the (k+1)th shift register in response to receiving a (k−1)th shift control signal.

8. The display apparatus of claim 6, wherein the control unit is configured to transmit the second initial control signal to the (k+1)th shift register in synchronization with the kth shift register transmitting a scan signal to the first secondary scan line in response to receiving a (k−1)th shift control signal.

9. The display apparatus of claim 1, further comprising:

data lines extending in the second direction; and a source driver configured to transmit data signals to the data lines in synchronization with the scan signals, wherein the pixels are connected to one of the primary scan lines and one of the data lines.

10. The display apparatus of claim 1, wherein a number of pixels connected to the second primary scan line having the third length is equal to or greater than a number of pixels connected to the first primary scan line having the first length.

11. The display apparatus of claim 1, further comprising:

a display unit having a circular shape, wherein the display unit comprises the primary scan lines, the secondary scan lines, and the pixels.

12. The display apparatus of claim 1, further comprising:

n extension scan lines, each extension scan line comprising:

a first end portion connected to the gate driver; and a second end portion connected to a corresponding secondary scan line of the n secondary scan lines.

13. A display apparatus comprising:

n primary scan lines extending in a first direction, where n denotes a positive integer;

n secondary scan lines extending in a second direction that is different from the first direction, the secondary scan lines respectively connected to one of the primary scan lines;

pixels connected to the primary scan lines;

a gate driver configured to transmit scan signals to the primary scan lines via the secondary scan lines;

a first metal layer comprising the primary scan lines;

a second metal layer comprising the secondary scan lines;

an insulation layer disposed between the first and second metal layers; and contact plugs penetrating the insulation layer and connecting the primary scan lines and the secondary scan lines, wherein the primary scan lines comprise two adjacent primary scan lines, the secondary scan lines comprise two secondary scan lines respectively connected to the two adjacent primary scan lines, and the secondary scan lines comprise at least one secondary scan line disposed between the two secondary scan lines.

14. The display apparatus of claim 13, wherein the primary scan lines comprise first to nth primary scan lines sequentially arranged in the second direction, the secondary scan lines comprise first to nth secondary scan lines sequentially arranged in the first direction, wherein a primary scan line disposed closer to the center of the display apparatus has a length that is equal to or longer than a length of a primary scan line disposed farther from the center of the display apparatus, and wherein a secondary scan line disposed closer to the center of the display apparatus has a length that is equal to or longer than a length of a secondary scan line disposed farther from the center of the display apparatus.

15. The display apparatus of claim 14, wherein a jth primary scan line has a length that is equal to or shorter than a length of a (j+1)th primary scan line, and a (k+j)th primary scan line has a length that is equal to or longer than a length of a (k+j+1)th primary scan line; and a (j)th secondary scan line has a length that is equal to or shorter than a length of a (j+1)th secondary scan line, and a (k+j)th secondary scan line has a length that is equal to or longer than a length of a (k+j+1)th secondary scan line, wherein n denotes a positive integer of 2k, k denotes a positive integer, and j denotes a positive integer that is less than k.

16. The display apparatus of claim 14, wherein the first to a kth primary scan lines are connected to a kth to the first secondary scan lines, respectively, and a (k+1)th to the nth primary scan lines are connected to the nth to a (k+1)th secondary scan lines, respectively, where n denotes a positive integer of 2k and k denotes a positive integer.

17. The display apparatus of claim 14, wherein the gate driver comprises a first sub-gate driver and a second sub-gate driver, wherein the first sub-gate driver comprises first to kth shift registers sequentially arranged in a third direction that is opposite the first direction, wherein the second sub-gate driver comprises (k+1)th to nth shift registers sequentially arranged in the third direction, wherein the first to kth shift registers are configured to transmit scan signals to a kth to the first secondary scan lines, respectively, and the (k+1)th to nth shift registers are configured to transmit scan signals to the nth to a (k+1)th secondary scan lines, respectively, where n denotes a positive integer 2k and k denotes a positive integer.

18. The display apparatus of claim 13, further comprising:

data lines extending in the second direction; and a source driver configured to transmit data signals to the data lines in synchronization with the scan signals, wherein the pixels are connected to one of the primary scan lines and one of the data lines.

19. The display apparatus of claim 13, further comprising:

a display unit having a circular shape, wherein the display unit comprises the primary scan lines, the secondary scan lines, and the pixels.

* * * * *